US008186853B2

(12) United States Patent
Popovsky

(10) Patent No.: US 8,186,853 B2
(45) Date of Patent: May 29, 2012

(54) CLEANSING AND PERSONAL CARE ARTICLE

(75) Inventor: Michael Popovsky, Beverly Hills, CA (US)

(73) Assignee: Spongeables, LLC, Inglewood, CA (US)

( * ) Notice: Subject to any disclaimer, the term of this patent is extended or adjusted under 35 U.S.C. 154(b) by 0 days.

(21) Appl. No.: 12/599,273

(22) PCT Filed: May 7, 2008

(86) PCT No.: PCT/US2008/005811

§ 371 (c)(1), (2), (4) Date: Nov. 6, 2009

(87) PCT Pub. No.: WO2008/137157

PCT Pub. Date: Nov. 13, 2008

(65) Prior Publication Data

US 2010/0242198 A1 Sep. 30, 2010

Related U.S. Application Data

(60) Provisional application No. 60/924,271, filed on May 7, 2007.

(51) Int. Cl.
*F21V 33/00* (2006.01)

(52) U.S. Cl. ..... 362/253; 362/154; 362/189; 362/101; 362/800

(58) Field of Classification Search ..... 362/96, 362/101, 154, 157, 189, 253, 800
See application file for complete search history.

(56) References Cited

U.S. PATENT DOCUMENTS

2005/0000046 A1* 1/2005 Popovsky et al. ..... 15/104.93

* cited by examiner

*Primary Examiner* — Stephen F Husar
*Assistant Examiner* — Meghan Dunwiddie
(74) *Attorney, Agent, or Firm* — Louis C. Paul

(57) ABSTRACT

A single- or multiple-use cleansing or personal care article comprising (i) a flexible, three-dimensional, water-absorbent substrate material comprising a cavity for accepting an electronic device within a waterproof housing, wherein the water-absorbent substrate is comprised of a web of substantially water-insoluble fibers and (ii) an electronic device within a waterproof housing comprised of one or more of a light-emitting device, a sound-emitting device, or an electromechanical vibrating device or a waterproof metered dispenser and either or both of (iii) a pourable soap impregnated into the water-absorbent material in an amount sufficient to produce foam in water having a di- or trivalent cationic salts present at a concentration of at least about 120 mg/L and/or (iv) a solid anhydrous composition having a melting point of from about 450 C to about 550 C said anhydrous composition comprising a haircare or skincare active ingredient.

5 Claims, 6 Drawing Sheets

CLEANSING AND PERSONAL CARE ARTICLE

CROSS-REFERENCE TO RELATED APPLICATIONS

This application is directed to novel applications of the subject matter claimed in PCT/US2004/021435 (published as WO20051007789) and U.S. patent application Ser. No. 10/696,069 (published as US Patent Application Publication No. 2005/0000046) and PCT/US2007/013478 (published as WO 2007/146103), each of which claims priority to U.S. Provisional Patent Application 60/484,786. This application claims priority to U.S. Provisional Application 60/924,271 filed on May 7, 2007. This application is a continuation-in-part of PCT/US2007/013478. Priority is thus claimed to U.S. Provisional Applications 60/924,271 and 60/484,786, U.S. Non-Provisional application Ser. No. 10/696,069 as well as international applications PCT/US2007/013478 and PCT/US2004/021435. The disclosures of each of these applications are incorporated herein by reference in their entirety.

FIELD OF INVENTION

The present invention relates to personal care articles useful for cleansing keratinized materials (i.e., hair, nails and skin).

BACKGROUND OF THE INVENTION

U.S. Pat. No. 4,861,505 discloses a novelty soap bar, the interior of which contains an electronic device in a water-impermeable, preferably plastic, housing. The device is comprised of an electronic circuit including a switch for opening and closing the circuit which is programmed or designed to emit a visible signal, tone, melody or message when the switch is closed. In addition to vibration- and temperature-sensitive switches, the '505 patent teaches the use of a magnetic reed switch which is held open in the presence of a magnetic field and closed in the absence of the magnetic field. The '505 patent also teaches the use of the above-described novelty soap bar in combination with a bathing mitt. (To the extent pertinent, granted US patents and published US patent applications disclosed in this application are incorporated by reference in their entirety.)

U.S. Pat. No. 5,971,827 teaches a novelty soap bar comprised of a substantially translucent or transparent soap surrounding an electronic module that emits a visible or audible signal that is perceptible through the soap body. Both motion- and light-sensitive switches are taught. In one embodiment of the invention taught in the '827 patent, actuation of the switch produces an animated sequence visible through the soap bar. The animated sequence may be formed using light-emitting diodes (LEDs), liquid crystal displays (LCDs), reflective sheets, or an electromechanical carousel.

U.S. Pat. No. 6,116,753 teaches another novelty soap bar, one in which light is emitted when the bar is wet. More particularly, the '753 patent teaches a soap bar in which the bottom of a waterproof light-transmitting housing is exposed to the soap body. When the soap bar is wet, a conductive path (i.e., circuit) is established between two electrodes. The conductive medium is taught to be water.

U.S. Pat. No. 6,746,135 teaches a donut-shaped soap body containing a "special effects cartridge" in a sealed chamber which emits sound, light and/or a back-lit image. The cartridge is taught to be triggered by movement or by wetting of the soap bar. Among the component parts taught by the '135 patent is an open acoustic chamber housing a miniature loudspeaker.

U.S. Pat. No. 6,802,819 teaches a novelty bar of soap containing an electro-mechanical vibrating mechanism.

U.S. Pat. No. 5,316,689 teaches a bar soap containing a super-compressed sponge novelty item (e.g., toy figurine) that expands and is released from the soap when the soap becomes sufficiently thin to permit moisture to enter and expand the super-compressed sponge.

The use of sponge-like coverings on electronic devices used in personal care applications in a bathroom setting (i.e., in the shower or bath) is known in the prior art. Such applications include sponge-covered electromechanical devices that produce vibration when contacted with the body.

U.S. patent application Ser. No. 10/696,069 published as US Patent Application Publication No. 2005/0000046 and teaches a multiple-use "cleansing pad", defined to include a sponge, comprising a pourable soap.

International Patent Application PCT/US2004/021435 published as WO 2005/1007789 and claims priority to U.S. Provisional Patent 60/484,786 and U.S. patent application Ser. No. 10/696,069. This application teaches a multiple-use cleansing pad/sponge comprising a pourable soap that lathers in both soft and hard water. The disclosed cleansing pad/sponge is also taught to deposit conditioning, moisturizing and other skin care ingredients on the skin.

International Patent Application PCT/US2007/013478 published as WO 2007/146103 and claims priority to US Provisional Application U.S. Provisional Patent 60/484,786. This application teaches a method for delivering active ingredients to a wet substrate from a flexible, three-dimensional, water-absorbent substrate material comprised of a web of substantially water-insoluble fibers into which is infused a solid anhydrous composition having a melting point from about 45° C. to about 55° C. said anhydrous composition comprising (i) at least one surfactant selected from the group consisting of cationic quaternary surfactants, anionic surfactants or nonionic surfactants or one multi-lamellar liquid crystal emulsifier system, (ii) at least one fatty alcohol, (iii) at least one emollient selected from the group consisting of cosmetically-acceptable oils, esters and liquid triglycerides, (iv) at least one active ingredient and (v) optionally, a solid cleansing agent having a melting point from about 50° C. to about 70° C. Preferred active ingredients taught are skincare and haircare actives, including emollients, humectants, conditioning agents, sunscreens and sunblocks, and artificial tanning agents.

SUMMARY OF THE INVENTION

Figure 1A:
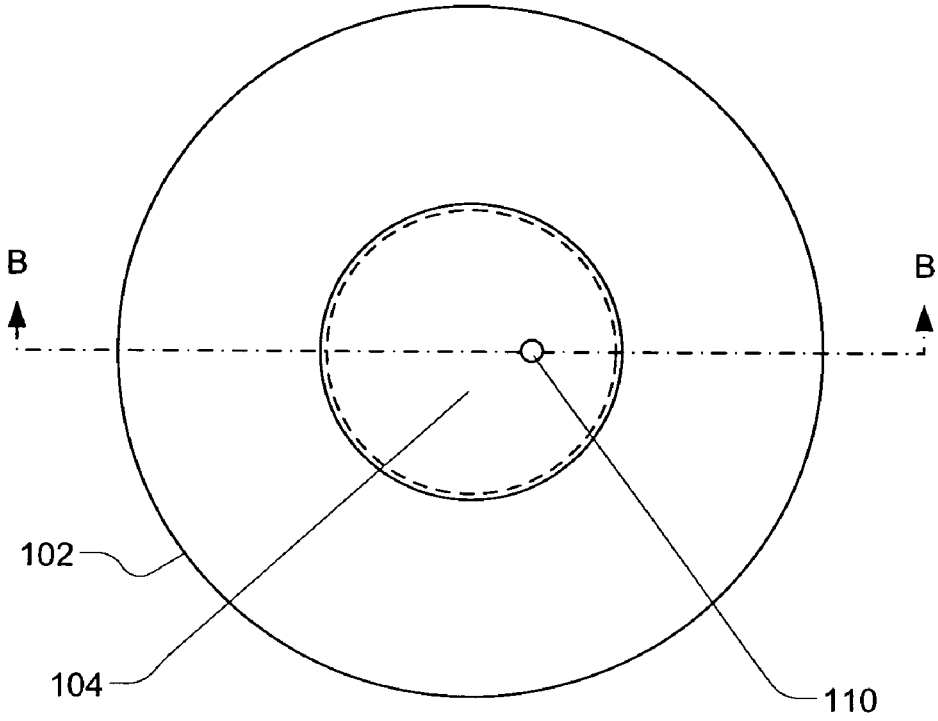
FIG. 1 depicts a torus-shaped sponge 102 with a module 104 securely fit within the center of the torus. In this embodiment the power source is a battery 106, the output devices are a sound-emitting device 108 (e.g., electric or piezo electric speaker) a light-emitting diode ("LED") 110, a printed circuit board ("PCB") 112, which controls the pattern of sounds and/or lights from the output devices, and a switch 114 to activate and deactivate the devices. The switch may be actuated manually (e.g., by a push button) or by lifting or placing the apparatus on a surface.
Figure 1B:
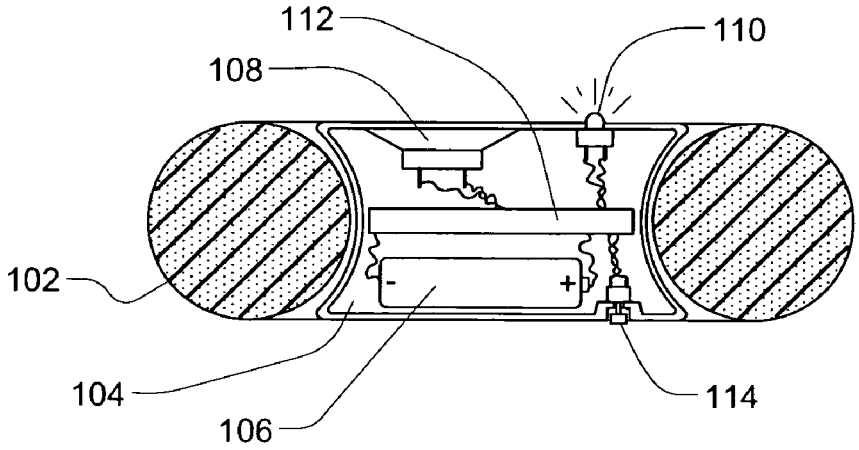
Figure 2A:
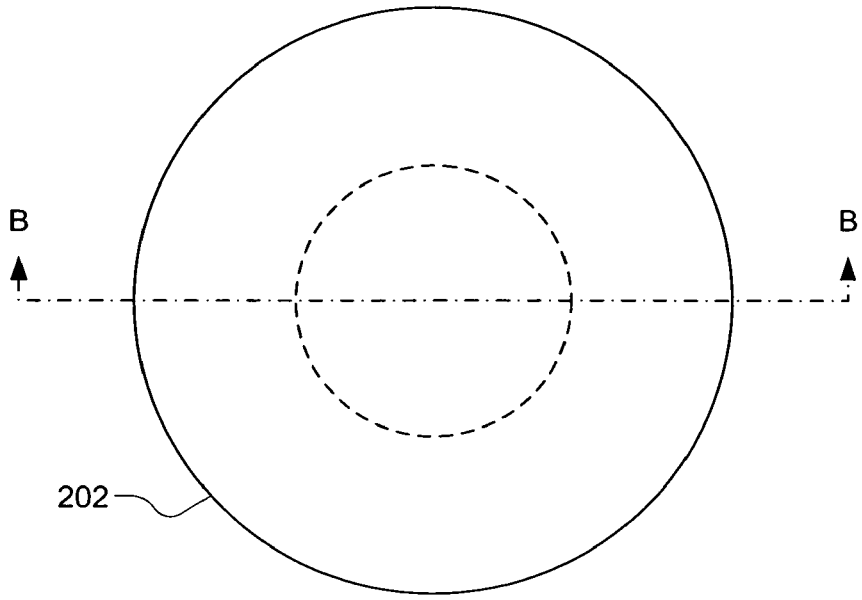
FIG. 2 shows the present invention with a sponge 202 having a slit 204 to allow insertion of a sound- and/or light-emitting module 206 in a cavity internal to the sponge. In this embodiment, power comes from a battery 208, is switched by a weighted reed switch 210 to power the PCB when the apparatus is moved. Other motion-activated switches known to those of skill in the art may also be used. Output from the unit includes sound from a coil, piezo electric or other speaker 212, light from one or more LEDs 214 and vibration from an unbalanced motor vibrating apparatus 216 or other vibrating means commonly used in the art.
Figure 2B:
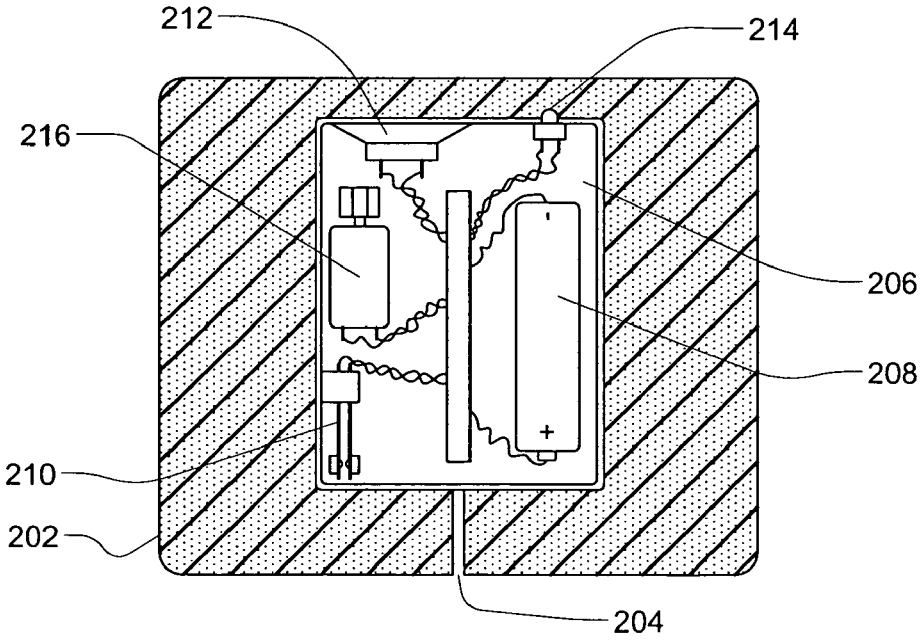
Figure 3:
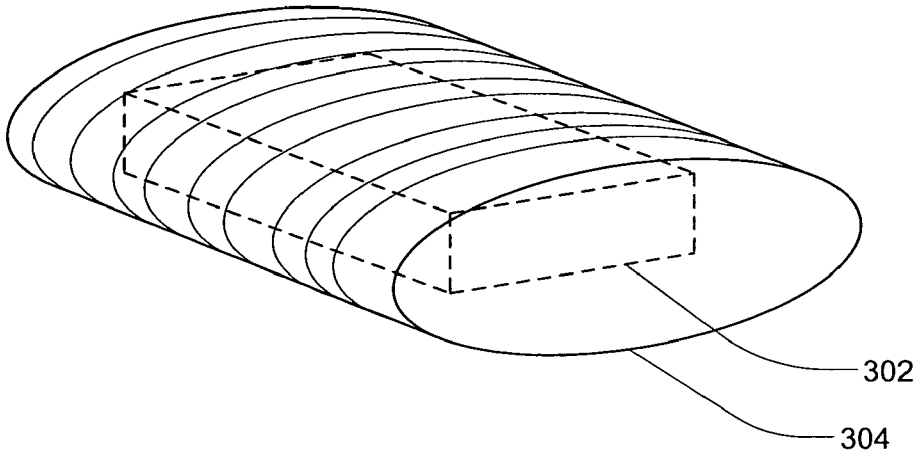
FIG. 3 depicts a module 302 concealed in a loofah sponge 304. The sponge material may be fibrous, one or more layers of porous material(s), natural or man-made sponge(s), abrasive sponge material or any material commonly used in cleaning sponges or apparatus.
Figure 4:
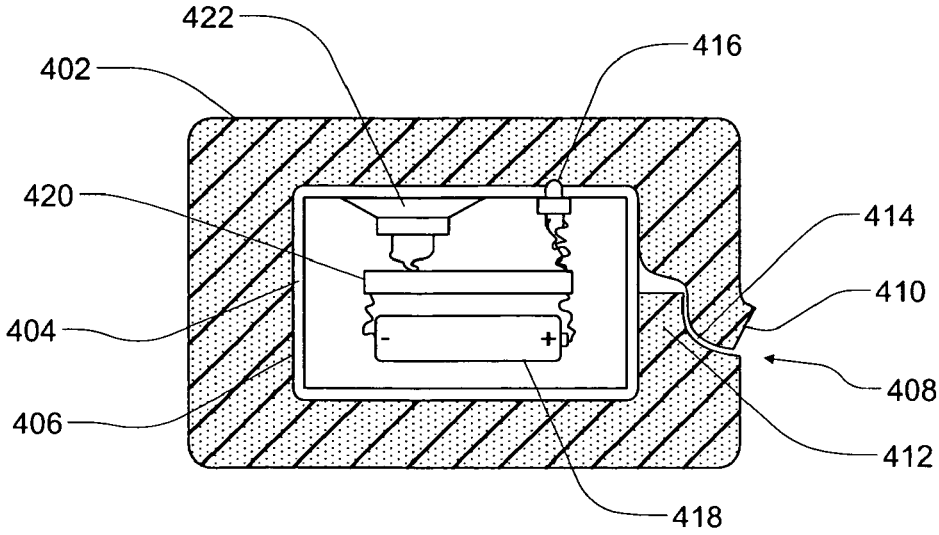
FIG. 4 shows a sponge 402 having a module 404 comprising a battery 418, a PCB 420, and sound-emitting device 422 in a pocket 406 within the sponge where the sponge has an opening 408 that is sealed by two overlapping flaps 410 and 412. The flaps may adhere to each other by a hook and loop fastener system 414 (e.g., Velcro®). The sponge material is thin enough or translucent such that LEDs 416 may shine through the module to illuminate areas of the sponge or shine through the sponge material. No switch is shown; the device as depicted either functions constantly or randomly as dictated by circuitry on the PCB.
Figure 5:
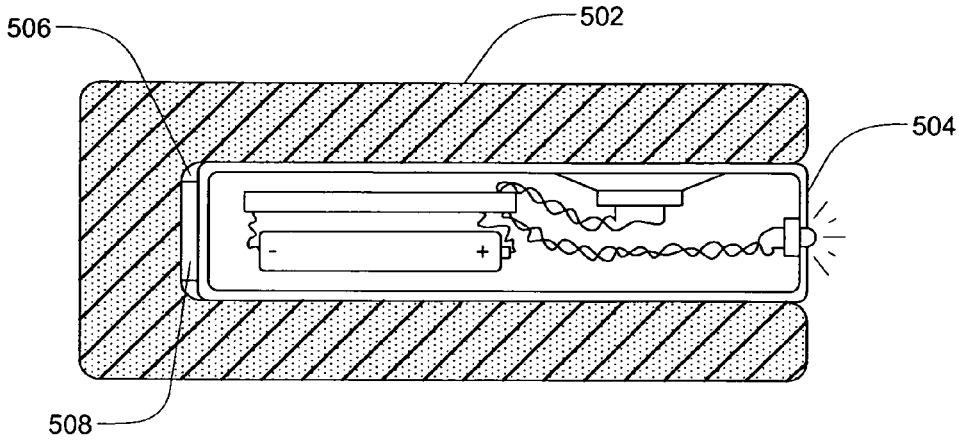
FIG. 5 shows a sponge 502 where the module 504 is retained in a pocket 506 within the sponge by double-sided adhesive strips or glue 508 in the sponge cavity.
Figure 6:
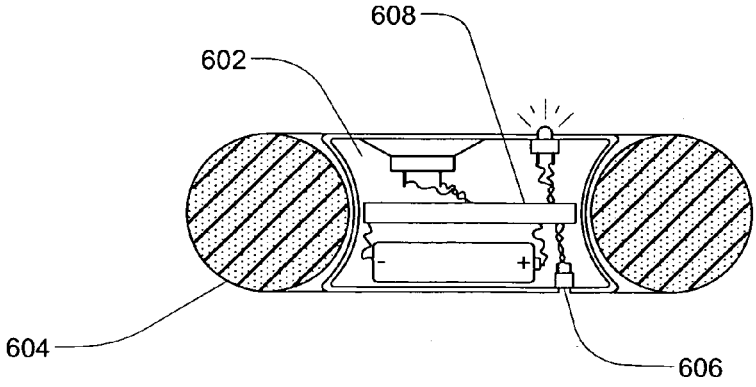
FIG. 6 depicts an embodiment where the module 602 within the sponge 604 is actuated by a light-sensitive switch 606. The switch may be configured to detect light or darkness or changes in light and may turn the apparatus on intermittently or for the duration of an operational sequence as determined by the logic programmed into the PCB 608.
Figure 7:
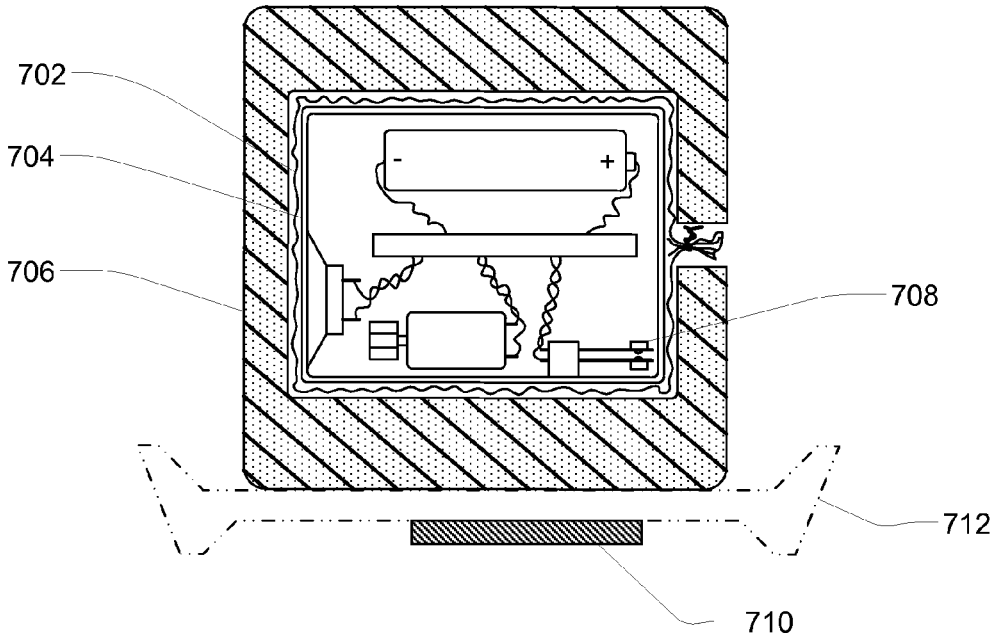
FIG. 7 includes a non-porous bag 702 between the module 704 and sponge 706 to protect the module and its contents from moisture or other environmental factors that may permeate the sponge but must not contact or enter the module. In this embodiment, the module is (de)activated by a magnetically actuated reed switch 708 that detects the presence or absence of a magnetic field generated by an external permanent magnet 710. The external magnet may be in a soap dish 712.
Figure 8:
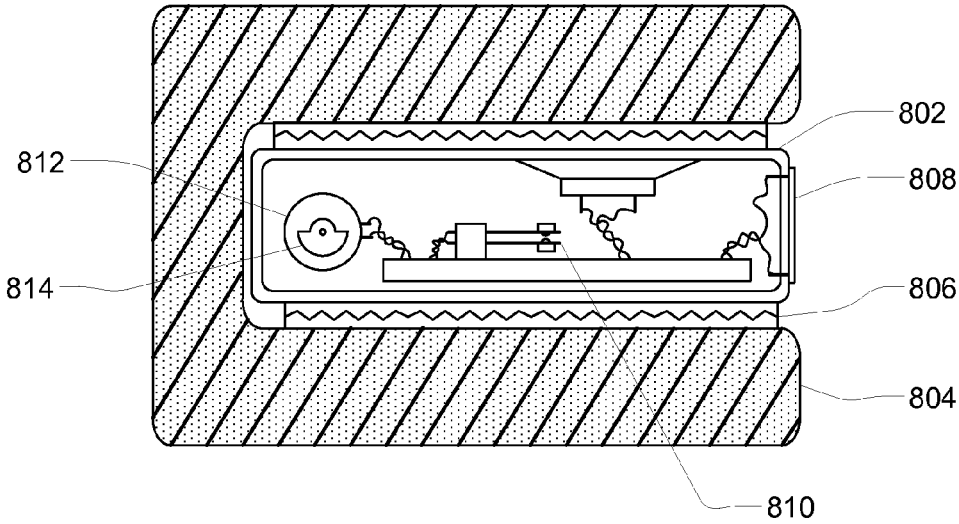
FIG. 8 shows the module 802 retained inside the sponge 804 by hook and loop fasteners 806. In this embodiment, power is supplied to the module by a solar cell 808. The module is activated by a switch 810 or exposure to a sufficient amount of light to produce electricity in the photo voltaic cell. In this embodiment an end view of the vibrating motor 812 is shown to depict the unbalanced shape of a weight 814 attached to the motor aperture to create a vibrating effect when the motor is activated.
Figure 9A:
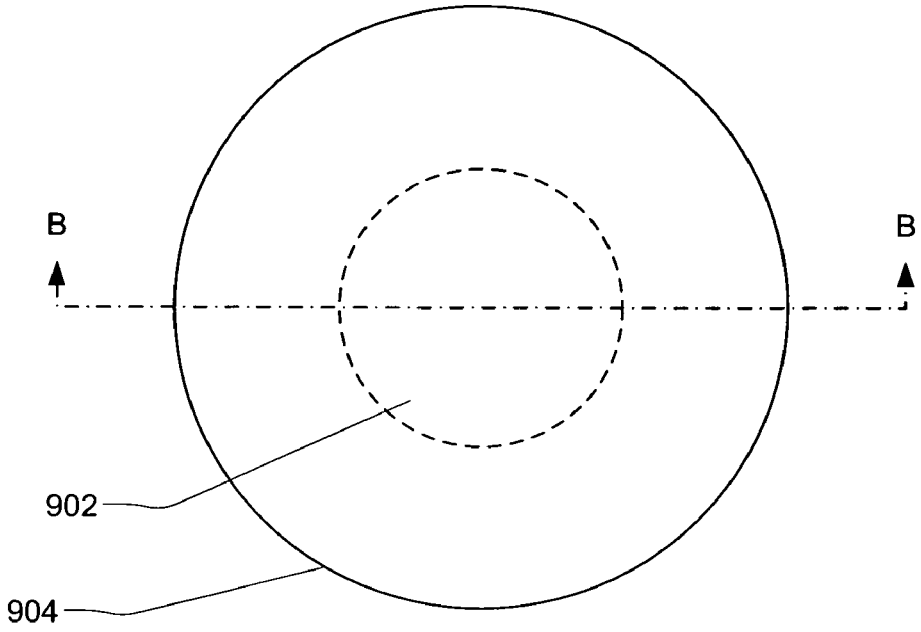
FIG. 9 depicts an embodiment in which power to the module 902 encased within the sponge 904 is supplied by a miniature generator 906 consisting of a magnet 908 that moves in proximity to a coil 910 to create electricity. The device may be activated by a switch 912 or movement sufficient to generate electricity.
Figure 9B:
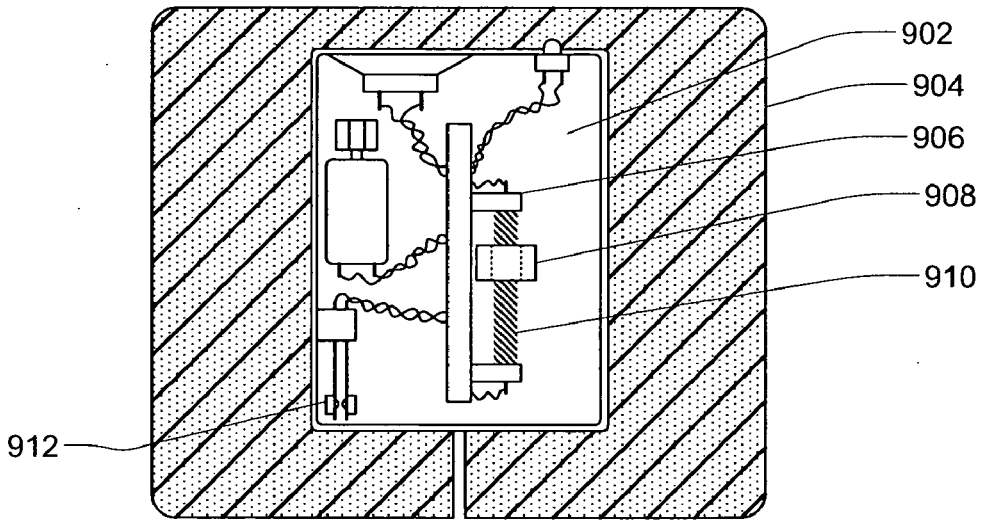

The present invention is directed to a single- or multiple-use cleansing article comprising (i) a flexible, three-dimensional, water-absorbent substrate material comprising a cavity for accepting an electronic device within a waterproof housing, wherein the water-absorbent substrate is comprised of a web of substantially water-insoluble fibers; (ii) an electronic device within a waterproof housing comprised of (a) one or more of a light-emitting device, a sound-emitting device, or an electro-mechanical vibrating device; and (b) a programmable integrated circuit for producing a predetermined sequence of light effects, sound effects or vibrations when actuated by a switch; and (c) a switch; and (d) a direct current power source selected from the group consisting of electrochemical cells, solar cells, or motion-actuated power cells comprised of a magnet, a wire induction coil and a storage capacitor wherein the storage capacitor is charged by shaking that produces light, sound or vibrations in a manner that is audibly, visibly or tactilely perceptible to the user through the water-absorbent substrate material when the switch is actuated; and (iii) a pourable soap impregnated into the water-absorbent material in an amount sufficient to produce foam in water having a di- or trivalent cationic salts present at a concentration of at least about 120 mg/L.

DETAILED DESCRIPTION OF THE INVENTION

The present invention relates to a single- or multiple-use cleansing article comprising:

(i) a flexible, three-dimensional, water-absorbent substrate material comprising a cavity for accepting an electronic device within a waterproof housing, wherein the water-absorbent substrate is comprised of a web of substantially water-insoluble fibers;

(ii) an electronic device within a waterproof housing comprised of (a) one or more of a light-emitting device, a sound-emitting device, or an electromechanical vibrating device; and (b) a programmable integrated circuit for producing a predetermined sequence of light effects, sound effects or vibrations when actuated by a switch;

(c) a switch; and (d) a direct current power source selected from the group consisting of electrochemical cells, solar cells, or motion-actuated power cells comprised of a magnet, a wire induction coil and a storage capacitor wherein the storage capacitor is charged by shaking that produces light, sound or vibrations in a manner that is audibly, visibly or tactilely perceptible to the user through the water-absorbent substrate material when the switch is actuated; and (iii) a pourable soap impregnated into the water-absorbent material in an amount sufficient to produce foam in water having a di- or trivalent cationic salts present at a concentration of at least about 120 mg/L.

While a preferred aspect of the present invention is directed to cleansing keratinized materials, the articles of the present invention may also be used to cleanse other substrates.

Flexible, Three-Dimensional, Water-Absorbent Substrate

Flexible, three-dimensional water-absorbent substrate materials suitable for use in the cleansing article of the present invention are well-known to those of skill in the art and are commercially-available from a number of suppliers. Water-absorbent, substrate materials may be natural, synthetic or both. They may comprise woven materials, nonwoven materials, polyurethanes (both open and closed cell), sponges or mixtures of the above. For purposes of the present application, substrate materials suitable for use in the cleansing article of the present invention as described in Paragraphs [0026]-[0028] are referred to as "sponge-like materials."

Suitable natural fibers include, but are not limited to, cellulosic fibers, such as wood pulp fibers and cotton. Suitable synthetic fibers include fibers commonly used in textiles, including, but not limited to, polyester, polypropylene, polyethylene and polyether and combinations thereof. Included within the term "synthetic fibers" are those obtained primarily from natural materials that have been further modified, either chemically, physically, or both. For example, rayon, a chemically-modified natural cellulosic fiber, may also be used in the present invention.

In one preferred embodiment of the present invention, the water-absorbent substrate is a non-woven high loft batting material which is sponge-like in structure and appearance. These materials, including methods of preparation thereof, are further described in US Patent Application Publication No. 2005/0125877.

Other materials suitable for use as water-absorbent, substrate materials in the present invention, include non-woven materials and polymeric sponges as described in U.S. Pat. Nos. 6,984,617 and 6,547,063.

Pourable Soap

As will be appreciated by persons of skill in soap making technology, soaps are generally produced by combining fats and/or oils with a solution of caustic soda (sodium hydroxide or lye) or potash (potassium hydroxide) in a specific amount to cause saponification, the breakdown of the fats and/or oils into their component fatty acids and glycerin. Glycerin is then separated from the fatty acids, either by "salting out" or through a fat splitter, a device which employs water under high pressure and at a high temperature to produce free fatty acids in an oil phase and glycerin in a water phase. The resulting crude soap may be purified, for example, by boiling in water and re-precipitating the soap with salt. In this manner, remaining glycerin, sodium chloride and sodium hydroxide are removed. The crude soap is then dried and compacted into small, solid pellets having a moisture content of about 10% to 20%. These pellets, in turn, are processed into personal care products including soap bars.

"Pourable soaps" as claimed in the present application are different from "soaps" as described in the preceding paragraph. Pourable soaps are produced from fats and oils without removal of the liberated glycerin. They are mixtures of crude soaps (with glycerin) to which additives, including additional glycerin, sugars, glycols, as well as small amounts of surfactants and/or alcohol(s) are added. These additional ingredients, in combination with the fatty acid salts, provide pourability and meltability as described below.

Pourable soaps according to the present invention are solid at temperatures of less than about 120° F. When heated above about 120° F.—generally from about 120° F. to about 160° F.—pourable soaps melt and become liquid. When cooled below this melting point range, pourable soaps are reconstituted in solid form without having undergone significant changes in composition. In contrast, soaps as described in Paragraph [0016] do not melt at elevated temperatures; instead, they decompose, char or burn. By the phrase "without having undergone significant changes in composition" is meant that, with the exception of a slight loss of water, the chemical composition of the pourable soap is essentially the same before and after melting/cooling.

Without being incorporated into a sponge-like material in the manner claimed in the present invention, pourable soaps produce essentially no foam in hard water when tested according to the method set out below in Paragraph [0034]. For purposes of this test, by "essentially no foam" is meant a foam height in a graduated cylinder of between 0 and 5 ml. By foam is meant a plurality of bubbles that form in or on the surface of a liquid. Also, for purposes of this test, by "hard water" is meant water containing 200 ppm of a divalent salt (i.e., of Calcium or Magnesium).

Test method: Prepare a 3% solution of the pourable soap to be tested by dissolving 3 grams of the soap in 97 ml of distilled water, using heat if necessary. Place 5 ml of the 3% soap solution into a 500 ml stoppered graduated cylinder. Add about 100 ml of hard water. With a pipette add 1 ml olive oil (a simple substitute for synthetic sebum); then, without agitation, add hard water in a quantity sufficient to achieve a final cylinder volume of 250 ml. Gently invert the graduated cylinder 10 times within 25 seconds, let stand 5 seconds, and read the height of the foam. A pourable soap will produce essentially no foam. In contrast, when the above experiment is repeated with distilled water in place of hard water, the pourable soap produces a significantly measurable amount of foam. By "significantly measurable" is meant a foam height of at least 50 ml in a graduated cylinder.

Foam height and quality may also be measured and characterized by preparing a 3% solution of a pourable soap and measuring (in mm) the quantity of foam generated by 100 ml of the solution after mixing for one minute in a blender or similar mixing apparatus known to those of skill in the art.

Other methodologies for measuring foam, or lack thereof, produced by a pourable soap cleansing product are known to those of skill in the art and include the "Standard Test Method for Foaming Properties of Surface-Active Agents" published as ASTM D1173-53 (2001), otherwise known as the Ross-Miles Foam Test.

The quality of foam produced by a pourable soap incorporated into a sponge-like material as claimed in the present, in water of varying degrees of hardness, is measured by a consumer panel according to the following scale: 0—none; 1—poor; 2—fair; 3—good; 4—very good; 5—excellent.

As will be understood by persons of skill in the art, hard water is water that has a specified mineral content, usually consisting of high levels of di- and tri-valent metal ions, mainly calcium and magnesium in the form of carbonates. Hard water may also include other metal ions (e.g. ferric), as well as other anions (e.g., chlorides and sulfates). The U.S. Department of the Interior (DOI), for example, has classified water hardness based on the grains per gallon concentration ("gpg") of minerals in water. Under the DOI scheme, water with 7.0 to 10.5 gpg mineral content (approximately, 120-180 ppm) is defined as hard. For purposes of the present application, "hard water" is defined as water having a concentration of di- or trivalent cationic salts of at least about 120 mg/L.

Waterproof Electronic Device

The cleansing article of the present invention comprises an electronic device contained within a waterproof housing that emits light, sound and/or mechanical vibrations. Such devices are known to those of skill in the art and are available from a variety of sources including those set out in the patents describing novelty soaps in the Background of Invention section of this application.

In one embodiment of the present invention, the electronic device within the cleansing article contains one or more light-emitting diodes.

In another embodiment of the present invention, the electronic device within the cleansing article emits sound from a speaker or piezoelectric device.

In yet another embodiment of the present invention, the electronic device within the cleansing article emits both light and sound in a manner that is perceptible to the user through the water-absorbent substrate material.

A variety of direct current power sources may be used to power the electronic device. Non-limiting examples of such power sources include power cells (e.g., lithium or solar) and batteries (metal hydride or alkaline).

The power source may also be a motion-actuated cell comprising a magnet, a wire induction coil and a storage capacitor as described in U.S. Pat. Nos. 5,975,714 and 6,220,719. In the devices described in the '714 and '719 patents, the storage capacitor is charged by shaking and thus provides electrical energy to the device.

The terms waterproof, water-tight and water-resistant are known to those of skill. Non-limiting examples of waterproof coatings, seals or coverings include thermoplastic resins, epoxy materials, rubbers, silicones and plastics. For purposes of the present the present invention, the terms "waterproof", "water-tight" and "water-resistant" are to be understood as synonymous and are used interchangeably.

As used in the present invention, by the term "waterproof housing" is meant a coating, seal or covering that surrounds the electronic device, rendering the device impermeable or resistant to water and/or moisture. The coating, seal or covering is sufficient to prevent permeation of water or moisture that would result in short-circuiting or malfunctioning of the device.

The switch in the electronic device may be actuated by light, change in temperature or the presence or absence of a magnetic field. Alternatively, the switch may be manually activated (e.g., by pushing a button or moving a toggle switch.)

The cleansing article of the present invention may also comprise one or more active ingredients used in treating the skin or hair including those disclosed in Paragraphs [0115]-[0118] of US Patent Application Publication No. 2005/0125877. Collectively, these ingredients are referred to hereinbelow as "skincare/haircare actives."

The articles of the present invention are used by the consumer by wetting or moistening the article with water and then rubbing the article against a keratinized material to produce foam.

In one embodiment of the present invention where the article comprising an electromechanical-vibrating device has been wet or moistened, the article is placed in contact with a keratinized material. The vibration alone, or in combination with a rubbing action, produces a foam.

In another embodiment of the present invention where the article comprises an electromechanical-vibrating device, the article need not be wet or moistened prior to being placed in contact with a keratinized material.

Another aspect of the present invention is directed to a personal care article comprising a sponge-like material impregnated with one or more skincare/haircare actives where the article contains a cavity for accepting an electronic device that emits sound waves, light waves and/or vibrational energy.

One embodiment of this aspect of the invention is directed to a personal care article comprising a sponge-like material impregnated with an anti-cellulite active and an electromechanical-vibrating device. By "anti-cellulite active" is meant ingredients known to those of skill in the art which when applied topically help reduce the appearance of cellulite. Non-limiting examples of anti-cellulite actives include xanthine compounds such as caffeine, theophylline, theobromine, and aminophylline.

Yet another aspect of the present invention is directed to a modular personal care sponge comprising:

(i) an outer member comprising a cavity or hole to accept an inner member designed to fit snugly within the outer member, thereby forming a unitary article with the outer member; and (ii) an inner member comprised of (a) one or more of a light-emitting device, a sound-emitting device, or an electromechanical vibrating device; and (b) a programmable integrated circuit for producing a predetermined sequence of light effects, sound effects or vibrations when actuated by a switch; and (c) a switch; and (d) a direct current power source selected from the group consisting of electrochemical cells, solar cells or motion-actuated power cells comprised of a magnet, a wire induction coil and a storage capacitor wherein the storage capacitor is charged by shaking that produces light, sound or vibrations in a manner that is audibly, visibly or tactilely perceptible to the user through the water-absorbent substrate material when the switch is actuated.

With respect to the inner member, by the phrase "fits snugly within the outer member, thereby forming a unitary article with the outer member" is meant the inner member is introduced into a cavity or hole within the outer member such that the degree of contact between the exterior surface of the cavity or hole of the outer member and the exterior surface of the inner member is sufficient to create a friction fit whereby the application of force is required to dislodge or remove the inner member from the outer member.

In a non-limiting example of this embodiment, the exterior surfaces of the outer member cavity/hole and the inner member are covered with a hook and loop fastener system such as that which is sold under the trademark Velcro®.

In one embodiment of this aspect of the invention, the outer core is comprised of a pourable soap impregnated into the water-absorbent material in an amount sufficient to produce foam in water having a di- or trivalent cationic salts present at a concentration of at least about 120 mg/L.

In a second embodiment of this aspect of the invention, the outer core is comprised of a skincare/haircare active. Articles according to this embodiment of the invention may be contacted directly with the skin or hair without wetting or moistening the outer core.

In a third embodiment of this aspect of the invention, the outer core is comprised of both a pourable soap in an amount sufficient to produce foam in water having a di- or trivalent cationic salts present at a concentration of at least about 120 mg/L and at least one skincare/haircare active.

A further aspect of the invention is directed to a cleansing article comprising a flexible, three-dimensional, water-absorbent substrate material comprising a cavity for accepting a waterproof metered, wherein the water-absorbent substrate is comprised of a web of substantially water-insoluble fibers.

In one embodiment of this aspect of the invention, the metered dispenser contains medicated or non-medicated topically-applied compositions.

By "topically-applied composition" is meant a cream, lotion, gel, dispersion or serum containing one or more ingredients known to those of skill in the art to provide a benefit to the user when applied topically. As will be appreciated by persons of skill in the art, the benefit may be in terms of treatment of a dermatologic condition or treatment of a systemic condition through transdermal delivery of a medicament.

The topically-applied composition may be medicated or non-medicated. By medicated is meant a cream, lotion, gel, dispersion or serum containing one or more active ingredients at concentration(s) for which a physician's prescription is required. A medicated topically-applied composition may also be one in which an ingredient or ingredient combination is classified "over-the-counter" and approved for sale without a physician's prescription.

In one embodiment of this aspect of the invention, the metered dispenser is a pump device that draws the non-medicated or medicated topically-applied composition (as defined above) through a first one-way valve from a pre-filled reservoir of the composition within the water-proof housing into a constant volume chamber such that the pump device dispenses through a second one-way valve the composition from the constant volume chamber during a single cycle (stroke) of the pump device.

In another embodiment of this aspect of the invention, the pump device is comprised of at least one one-way valve and draws and dispenses a volume of the non-medicated or medicated topically-applied composition equal to about the volume taken up through a single cycle (stroke).

Yet another aspect of the present invention is directed to a cleansing article comprised of two sponge halves, where each half is impregnated with a different material (e.g., pourable soap, medicated or non-medicated topically-applied composition), and the two sponges are joined, bonded, adhered, fastened or otherwise affixed to each other.

In one embodiment of this aspect of the invention, the two sponge halves are affixed to each other by direct application of heat and/or pressure.

In another embodiment of this aspect of the invention, an adhesive material is applied to the first sponge half which is capable of reacting with the second sponge half upon application of either pressure or heat or both.

It is to be understood that while certain aspects and embodiments described above are meant to address the heretofore unmet need for a product that provides a consumer-acceptable amount of foam in hard water, articles of the present invention may also be used in cleansing a keratinized material with water that is not "hard," but rather is "softened". By "softened water" is meant water having di- or trivalent cationic salts present at a concentration of less than about 120 mg/L, preferably less than about 20 mg/L.

EXAMPLES

Examples of pourable soaps and processes for impregnating the pourable soap into the flexible, three-dimensional, water-absorbent substrate (e.g., sponge-like material) are described in US Patent Application Publication No. 2006/0282966, including in Paragraphs [0047]-[0063] thereof.

A further example of a pourable soap is as follows:

| | |
|---|---|
| Aqua | 25%-50% |
| Glycerin | 10%-25% |
| Propylene Glycol | 10%-25% |
| Sodium Stearate | 10%-25% |
| Sodium Laurate | 5%-10% |
| Sodium Laureth Sulfate | 5%-10% |
| Sorbitol | 5%-10% |
| Sodium Lauryl Sulfate | 1%-5% |
| Lauric Acid | 0.5%-1.0% |
| Sodium Chloride | 0.5%-1.0% |
| Stearic Acid | 0.5%-1.0% |
| Pentasodium Pentetate | <0.1% |
| Tetrasodium EDTA | <0.1% |

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth hereinabove but rather that the claims be construed as encompassing all the features of patentable novelty which reside in the present invention, including all features which would be treated as equivalents thereof by those skilled in the art to which the invention pertains.

The invention claimed is:

1. A single- or multiple-use cleansing article comprising:

(i) a flexible, three-dimensional, water-absorbent substrate material comprising a cavity for accepting an electronic device within a waterproof housing, wherein the water-absorbent substrate is comprised of a web of substantially water-insoluble fibers; and (ii) an electronic device within a waterproof housing comprised of (a) one or more of a light-emitting device, a sound-emitting device, or an electromechanical vibrating device; and (b) a programmable integrated circuit for producing a predetermined sequence of light effects, sound effects or vibrations when actuated by a switch; and (c) a switch; and (d) a direct current power source selected from the group consisting of electrochemical cells, solar cells, or motion-actuated power cells comprised of a magnet, a wire induction coil and a storage capacitor wherein the storage capacitor is charged by shaking that produces light, sound or vibrations in a manner that is audibly, visibly or tactilely perceptible to the user through the water-absorbent substrate material when the switch is actuated; and (iii) a pourable soap impregnated into the water-absorbent material in an amount sufficient to produce foam in water having a di- or trivalent cationic salts present at a concentration of at least about 120 mg/L.

2. A modular personal care sponge comprising:

(i) an outer member comprising a cavity or hole to accept an inner member designed to fit snugly within the outer member, thereby forming a unitary article with the outer member; and (ii) an inner member comprised of (a) one or more of a light-emitting device, a sound-emitting device, or an electromechanical vibrating device; and (b) a programmable integrated circuit for producing a predetermined sequence of light effects, sound effects or vibrations when actuated by a switch; and (c) a switch; and (d) a direct current power source selected from the group consisting of electrochemical cells, solar cells or motion-actuated power cells comprised of a magnet, a wire induction coil and a storage capacitor wherein the storage capacitor is charged by shaking that produces light, sound or vibrations in a manner that is audibly, visibly or tactilely perceptible to the user through a water-absorbent substrate material when the switch is actuated.

3. A single- or multiple-use personal care article comprising:

(i) a flexible, three-dimensional, water-absorbent substrate material comprising a cavity for accepting an electronic device within a waterproof housing, wherein the water-absorbent substrate is comprised of a web of substantially water-insoluble fibers; and (ii) an electronic device within a waterproof housing comprised of (a) one or more of a light-emitting device, a sound-emitting device, or an electromechanical vibrating device; and (b) a programmable integrated circuit for producing a predetermined sequence of light effects, sound effects or vibrations when actuated by a switch; and (c) a switch; and (d) a direct current power source selected from the group consisting of electrochemical cells, solar cells, or motion-actuated power cells comprised of a magnet, a wire induction coil and a storage capacitor wherein the storage capacitor is charged by shaking that produces light, sound or vibrations in a manner that is audibly, visibly or tactilely perceptible to the user through the water-absorbent substrate material when the switch is actuated; and (iii) a solid anhydrous composition having a melting point of from about 45° C. to about 55° C. said anhydrous composition comprising (a) at least one surfactant selected from the group consisting of cationic quaternary surfactants, anionic surfactants and non-ionic surfactants;

(b) at least at least one fatty alcohol;

(c) at least one emollient selected from the group consisting of cosmetically-acceptable oils, esters and liquid triglycerides;

(d) at least one active ingredient; and (e) optionally, a solid cleansing agent having a melting point from about 50° C. to about 70° C.

4. A single- or multiple-use personal care article according to claim 3 wherein the optional solid cleansing agent having a melting point from about 50° C. to about 70° C. is a pourable soap in an amount sufficient to produce foam in water having a di- or trivalent cationic salts present at a concentration of at least about 120 mg/L.

5. A single- or multiple-use personal care article according to claim 3 wherein the active ingredient is a skincare active or haircare active selected from the group consisting of emollients, humectants, occlusive conditioning agents, sunscreens or physical sun blocks, self-tanning agents, anti-inflammatory agents, antioxidants, vitamins and derivatives thereof, skin soothing agents and skin bleaching/lightening agents.

* * * * *